US005834995A

United States Patent [19]

Richards et al.

[11] Patent Number: 5,834,995

[45] Date of Patent: Nov. 10, 1998

[54] CYLINDRICAL EDGE MICROSTRIP TRANSMISSION LINE

[75] Inventors: Randy J. Richards, Plano, Tex.; Mark C. Calcatera, Spring Valley; Bradley J. Paul, Beavercreek, both of Ohio

[73] Assignee: The United States of America as represented by the Secretary of the Air Force, Washington, D.C.

[21] Appl. No.: 847,082

[22] Filed: May 1, 1997

[51] Int. Cl.[6] ..... H01P 3/08

[52] U.S. Cl. ..... 333/238; 205/123

[58] Field of Search ..... 333/238; 174/32, 174/33, 68.1, 117 F, 117 FF, 253

[56] References Cited

U.S. PATENT DOCUMENTS

| | | | |
|---|---|---|---|
| 2,877,426 | 3/1959 | Kostriza et al. | 333/238 X |
| 2,983,884 | 5/1961 | Rueger | 333/238 X |
| 3,811,186 | 5/1974 | Larnerd et al. | 174/253 X |
| 3,886,506 | 5/1975 | Lorber et al. | 333/243 |
| 4,759,028 | 7/1988 | Nettleton et al. | 372/82 |
| 4,833,521 | 5/1989 | Early | 257/664 |
| 4,891,614 | 1/1990 | De Ronde | 333/122 |
| 5,010,309 | 4/1991 | Manssen | 333/206 |
| 5,369,381 | 11/1994 | Gamand | 333/161 |
| 5,408,742 | 4/1995 | Zaidel et al. | 29/846 |

*Primary Examiner*—Paul Gensler

*Attorney, Agent, or Firm*—Gerald B. Hollins; Thomas L. Kundert

[57] ABSTRACT

A transmission line arrangement providing control of signal losses through the use of conductor cross-sectional surface area-increasing and skin effect-considered bulbous additions to the rectangular conductor cross-sectional shape frequently used in semiconductor device transmission line conductors. The achieved transmission line is especially suited for use in radio frequency integrated circuit assemblies where it also includes a backplane member, encounters signals in the microwave and millimeter wavelength range and involves conductor dimensions measured in micrometers. Control of transmission line characteristic impedance at, for example, 50 ohms is disclosed as is use of semiconductor device-compatible materials and loss comparisons data.

10 Claims, 12 Drawing Sheets

CYLINDRICAL EDGE MICROSTRIP TRANSMISSION LINE

RIGHTS OF THE GOVERNMENT

The invention described herein may be manufactured and used by or for the Government of the United States for all governmental purposes without the payment of any royalty.

BACKGROUND OF THE INVENTION

This invention concerns the field of electrical energy transmission lines and especially the variety of radio frequency energy transmission lines known as microstriplines as are often used within integrated circuit electronic devices.

Even though transmission line dielectric energy losses are known to increase at higher operating frequencies, a major component of microstrip transmission line loss remains in conductor energy dissipation when the transmission line is used at microwave, millimeter wave and higher frequencies. Since these conductor losses increase as the current density increases in a transmission line conductor, the known phenomenon of skin effect conduction and the resulting current crowding in a conductor can have significant influence on line losses occurring in higher frequency applications. The present invention demonstrates, however, that these conductor related energy losses may be controlled through use of transmission line conductors disposed in skin effect-considered configurations.

The U.S. patent art indicates the presence of significant inventive activity in the area of transmission lines and their loss-considered radio frequency operation. Patents in this art are, for example, concerned with the skin effect phenomenon and with combinations of this phenomenon with ground planes, integrated circuits and loss-considered structures. The use of circular configurations in transmission line conductors is also shown in certain of these patents.

None of these patents is, however, understood to disclose the extensively rounded bulbous shape for a transmission line conductor of a microstrip or related type of transmission line that is disclosed in the present invention nor the high radio frequency energy and loss-related considerations which support use of this shape.

SUMMARY OF THE INVENTION

The present invention concerns an electrical transmission line of reduced conductor energy losses and optimized conductor cross-sectional shape, e.g., microwave and millimeter wave electrical circuit use.

It is an object of the present invention, therefore, to provide an improved microstrip transmission line that offers lower power loss than previous microstrip transmission lines of the same cross-sectional area and differing geometry.

It is also an object of the invention to provide a transmission line which improves on the conductor losses usually occurring in microwave and millimeter wave transmission lines.

It is another object of the invention to provide a microstrip transmission line which deploys an available quantity of conductor metal to the greatest advantage for use in a microwave or millimeter wave integrated circuit device.

It is another object of the invention to provide a microstrip transmission line employing a reduced amount of conductor metal to obtain a specific power loss.

It is another object of the invention to provide a microstrip transmission line which can be accomplished with reduced fabrication costs.

It is another object of the invention to reduce skin effect related conduction current density crowding along edges of a microstrip transmission line conductor.

It is another object of the invention to reduce the skin effect produced conduction current density crowding in acute corner locations of a microstrip transmission line conductor.

It is another object of the invention to provide these improvements for a variety of different transmission line types, including slotlines, striplines, coplanar lines and microstriplines, for example.

It is another object of the invention to provide a transmission line of decreased skin effect signal attenuation characteristics.

It is another object of the invention to provide a microstrip transmission line of reduced metal content per unit of energy loss.

It is another object of the invention to provide a microstrip transmission line of lower power loss than a conventional microstrip transmission line of the same cross-sectional area but different geometry.

It is another object of the present invention to reduce the conduction current density crowding along the edges and especially in the acute corners of a microstrip transmission line.

It is another object of the present invention to arrange a transmission line according to the effect of microstrip transmission line edge shape on conductor loss.

Additional objects and features of the invention will be understood from the following description and claims and the accompanying drawings.

These and other objects of the invention are achieved by integrated circuit microwave and millimeter wave transmission line apparatus comprising the combination of:

a transmission line dielectric layer member comprised of electrically insulating material of selected composition, dielectric constant and thickness dimension received within an integrated circuit electronic device;

an electrically conductive transmission line backplane member received on a bottom-most surface of said transmission line dielectric layer member; and an electrically conductive transmission line signal conductor member of rectangular lower cross-sectional portion shape, selected metallic composition, and selected cross-sectional width and thickness dimensions received on a topmost surface of said transmission line dielectric member;

said electrically conductive transmission line signal conductor member including a metallic conduction surface area-increasing upper cross-sectional external corner portion of bulbous rounded cross-sectional shape as an integral and lengthwise-extending portion thereof.

DETAILED DESCRIPTION

The skin effect in alternating current carrying conductors has been known and used as a guiding principle in designing electrical apparatus for at least several decades. In the area of circular configured conductors used in high tension and other electrical energy transmission applications, it has been common practice to dispose an alternating current-carrying conductor in the form of a hollow cylinder made of, for example, skewed tongue and groove-mated annular segments, in order to accommodate this skin effect phenomenon. It is also known to fabricate the electrical conductors in low to medium radio frequency inductance-capacitance tank circuits from hollow tubing as a weight and material saving arrangement which does not significantly degrade conductor performance. Each of these exemplary practices has been supported by an understanding that the omitted central section material in such conductors is not used or is inefficiently used in the electrical current conducting mechanism—as a result of the skin effect phenomenon.

When current carrying conductors are used in the environment of newly evolving military electronic apparatus or other cutting edge electronic equipment—equipment involving microwave or millimeter wave radio frequency signals processed in minimally sized gallium arsenide integrated circuit chips, for example, skin effects and certain other encountered effects lead to conductor phenomenon which are believed to be somewhat surprising notwithstanding these known skin effect concepts. In this environment of relatively high frequency currents, smallest possible conductor cross sections, specific conductor shapes, enforced use of transmission line concepts and need for minimal signal and power losses, it is found that certain special configurations of current-carrying conductors are helpful. This is the area of focus in the present invention.

Figure 1:
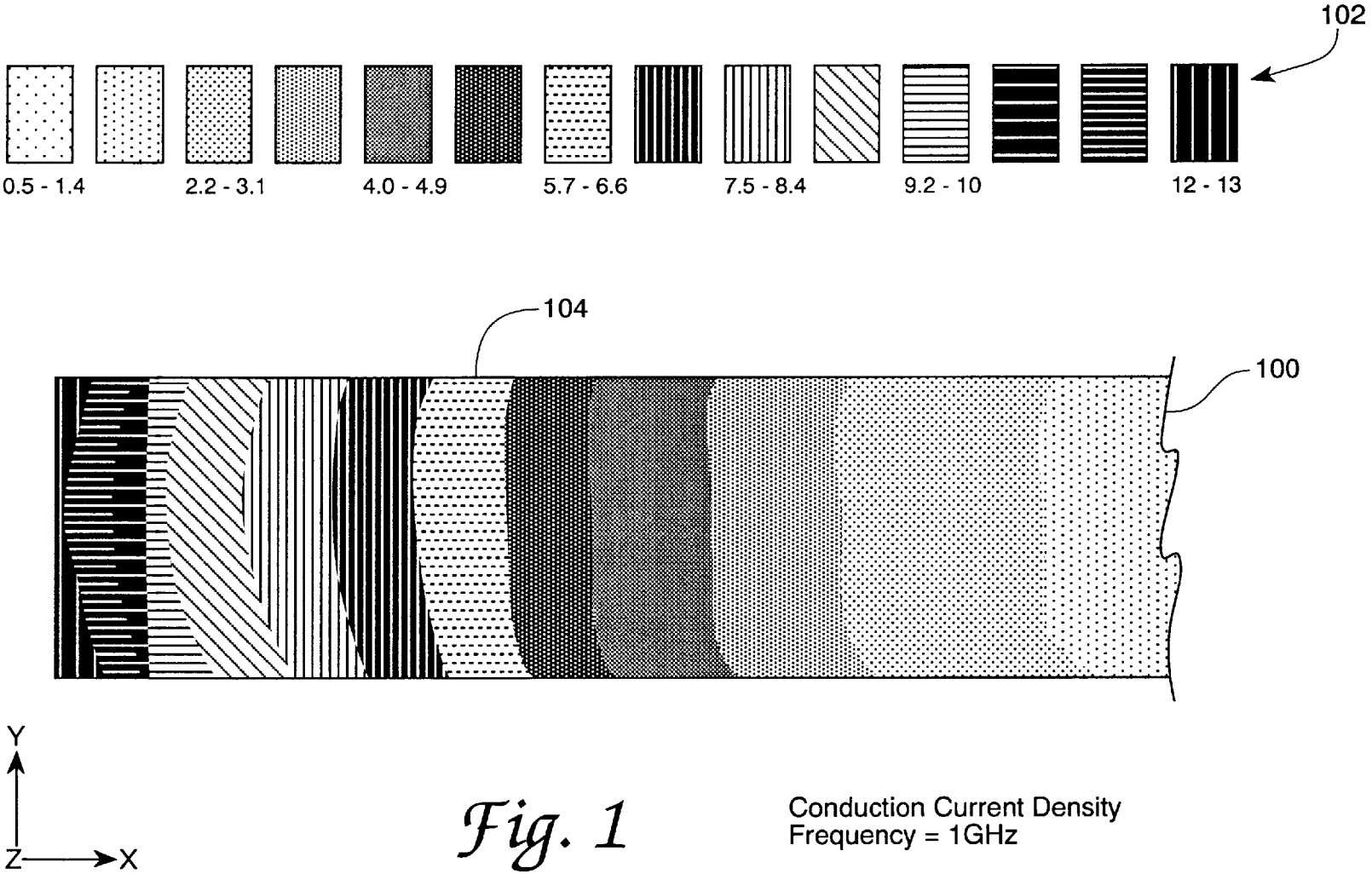
FIG. 1 shows the left half of a transmission line conductor and its current crowding characteristics at one operating frequency.

FIG. 1 in the drawings therefore shows an enlarged representation of the left side of a rectangular shaped conductor 104 usable in a microstrip transmission line—along with indications of the current density which occurs in various parts of this conductor during a flow of alternating current of one gigahertz frequency. Although the conductor 104 may be generally referred to as having this rectangular shape in its cross-section, the term "rectangular" is in reality only somewhat generally descriptive of the conductor cross-sectional shape actually achieved in most integrated circuit processing, since rounded corners, less than straight lines and other geometric imperfections are known to result from most conductor fabrications. Indeed, as is later described herein, acute angles and trapezoidal shaped conductors are commonly achieved in integrated circuit processing sequences. It is possible, therefore, that some integrated circuit processes may achieve conductor shapes which are actually better described with a term other than "rectangular", a term such as "closed geometric" or the like being perhaps more generic to the variety of shapes which may be fabricated. It is intended of course that the present invention and the present patent application not be limited by any particular starting or underlying shape for the conductor being improved upon; the terms "rectangular" and "closed geometric" are, therefore, each employed in the claims of this document as an indication of this intention.

In the FIG. 1 drawing the left hand-most drawing portion represents the left-most outer extremity of the conductor 104 and the right portion represents a more central portion of the conductor, a portion which is abbreviated at its center-most extremity with the conventional break-line 100. The right hand portion of the conductor 104 is not shown in the FIG. 1 drawing but will experience similar current densities to those illustrated in FIG. 1—absent some current-altering influence. At the top of the FIG. 1 drawing at 102 there is shown a range of relative or normalized current density values, together with the shading used to represent these densities within the conductor 104. Current densities intermediate the indicated numeric values of relative current density are presumed to exist in the FIG. 1 drawing, as is implied by the exemplary non-labeled shading samples in the array at 102. The FIG. 1 current density values at 102 are indicated to be relative values since the absolute current density values in conductor 104 depend on a number of complex factors and since the disclosed relative or normalized current values are believed equally effective in describing the invention. Parenthetically, symbol numbers herein are assigned in an arrangement wherein the first symbol digit is the same as the drawing number in which it appears; once assigned a number, an element's identity is, however, maintained in other drawing Figs. to the best degree possible.

Figure 2:
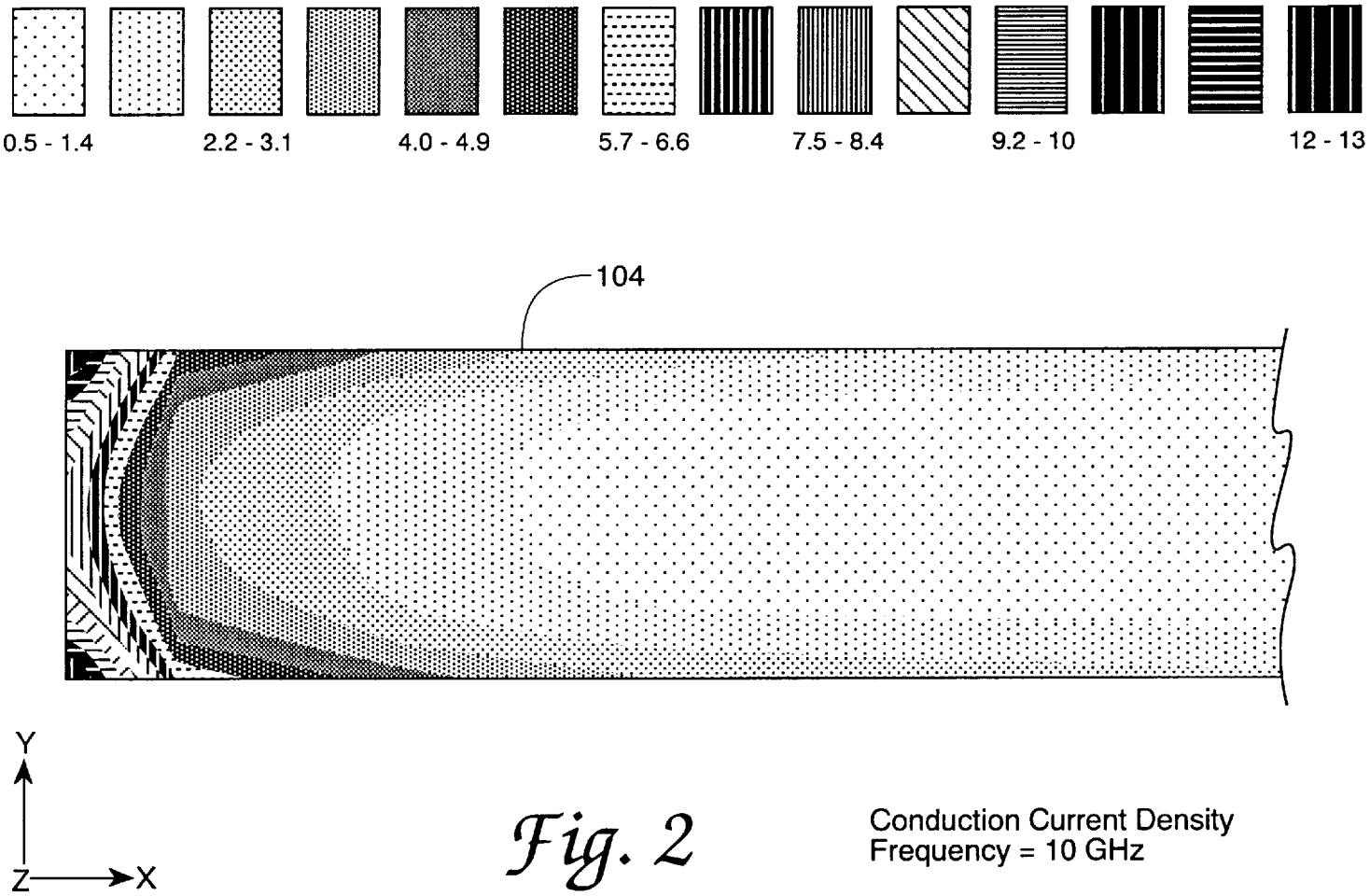
FIG. 2 shows the left half of a transmission line conductor and its current crowding characteristics at a second higher operating frequency.

FIG. 2 in the drawings shows the conductor 104 of FIG. 1 along with representations of normalized current density which occur in parts of the conductor during a flow of alternating current of a higher, ten gigahertz, frequency. The current crowding and the high density of the current in the outer corners of the FIG. 2 representation of conductor 104 are particularly notable aspects of the FIG. 2 drawing. In a similar manner FIG. 3 in the drawings shows the conductor 104 of FIG. 1 and FIG. 2 along with representations of the current density which occur during a flow of alternating current of forty gigahertz frequency. The more extreme current crowding and the high density of the current in smaller outer corner portions of the FIG. 3 depiction of conductor 104 are particularly notable aspects of the FIG. 3 drawing.

Figure 3:
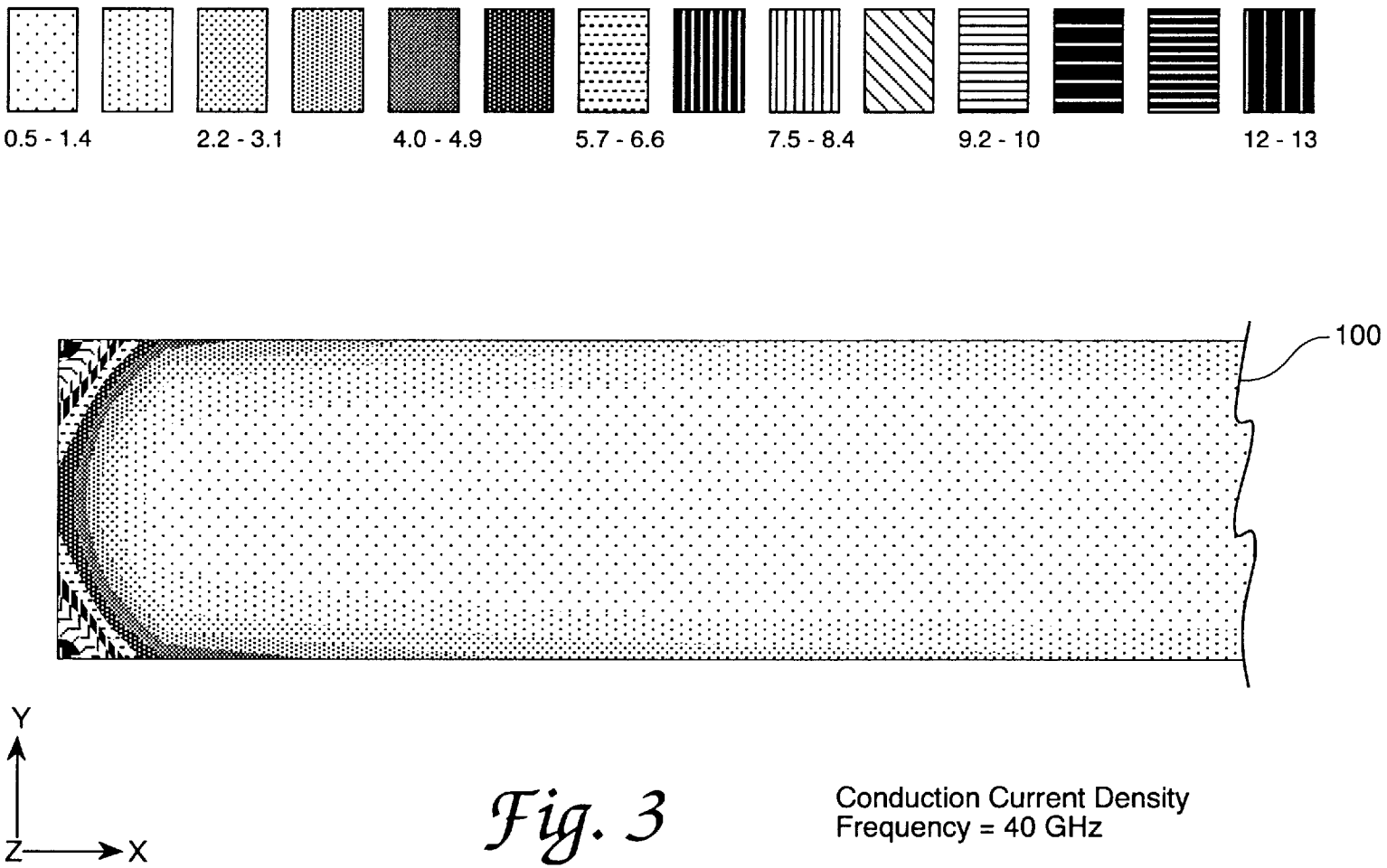
FIG. 3 shows the left half of a transmission line conductor and its current crowding characteristics at a third and higher yet operating frequency.

When considered as a combined group, the drawings of FIGS. 1–3 suggest that the geometry of a microstrip transmission line, coupled with the skin effect phenomenon, produce conduction current density crowding which increases with frequency and tends to concentrate in the corners of the microstrip transmission line. It is also notable that at the higher frequencies the conduction current density is greater along the top and bottom surfaces of the microstrip transmission line conductor than it is in the center. This is also due to the skin effect phenomenon where the conduction current density drops exponentially toward the center of the line conductor. These high conductor current densities are a foremost cause of the experienced transmission line increasing loss with increasing frequency phenomenon. As disclosed herein a reduction of the conduction current density by changing the microstrip transmission line edge shape geometry will reduce these conductor losses and moreover a particular shape disclosed herein is notably effective in reducing these losses. Also, limiting the thickness of the transmission line conductor to approximately 2.5 to 3 skin depth thicknesses will help reduce the amount of metal required to fabricate the microstrip transmission line.

The present invention therefore involves a microstrip transmission line having cylindrical edges. The geometry of the conductor edges is a significant consideration in removing the above described conduction current density crowding in the corners and on the end of the microstrip transmission line. Electromagnetic modeling using a computer program *such as Ansoft's EMAS simulator developed by MacNeal Schwendler may be of assistance in viewing trends and guiding modifications to accomplish desired changes in the transmission line geometry. Generally the adding of a cylindrical edge with a radius equal to the microstrip transmission line thickness as shown in FIG. 4*c* is found sufficient to spread the conduction current over a larger area of a transmission line conductor; thus reducing the conductor losses.

Figure 4A:
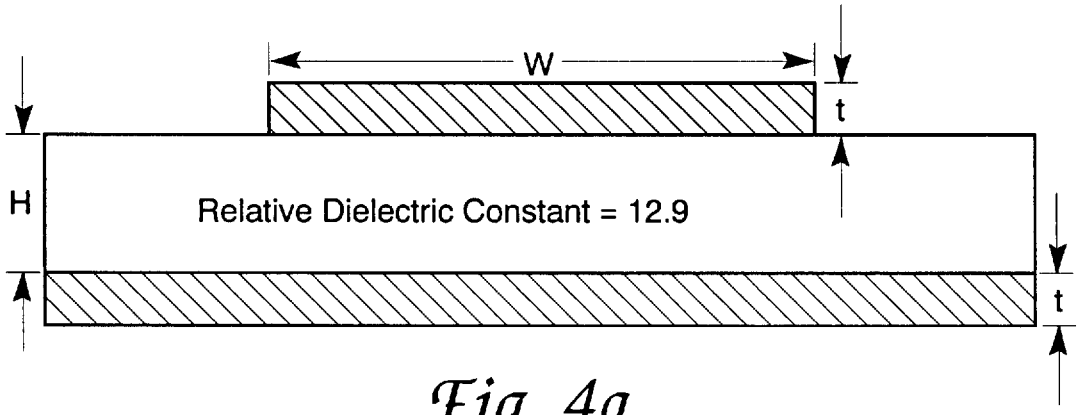
FIG. 4*a* shows a particular transmission line conductor configuration and its surroundings in a transmission line.
Figure 4B:
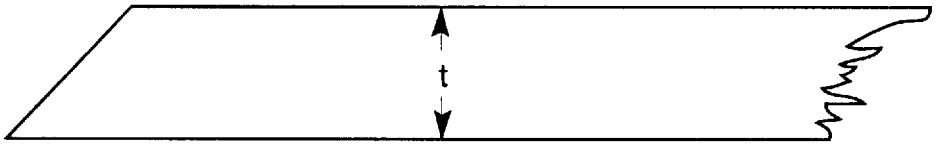
FIG. 4*b* shows another transmission line conductor configuration for the FIG. 4*a* transmission line.
Figure 5:
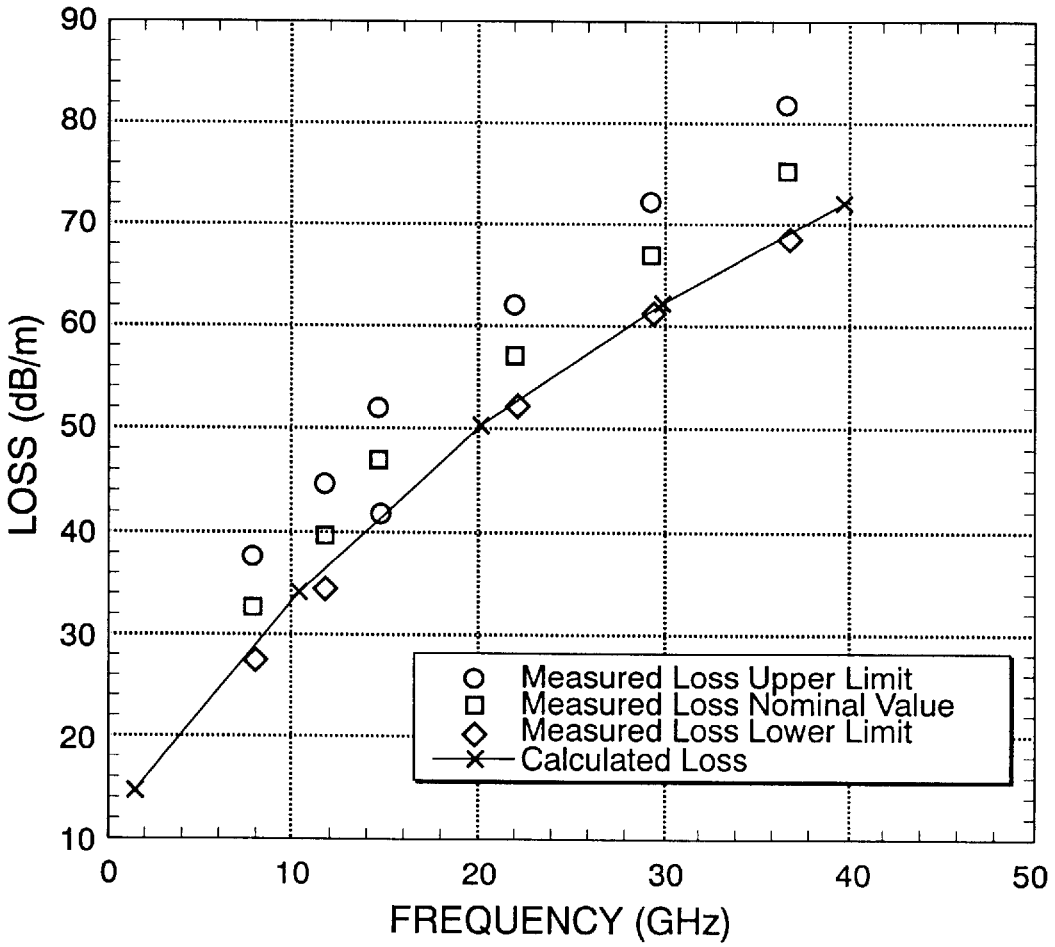
FIG. 5 shows a relationship between transmission line losses and operating frequency as determined by calculation and measurement for the conductor shape shown in FIG. 4*a*.
Figure 6:
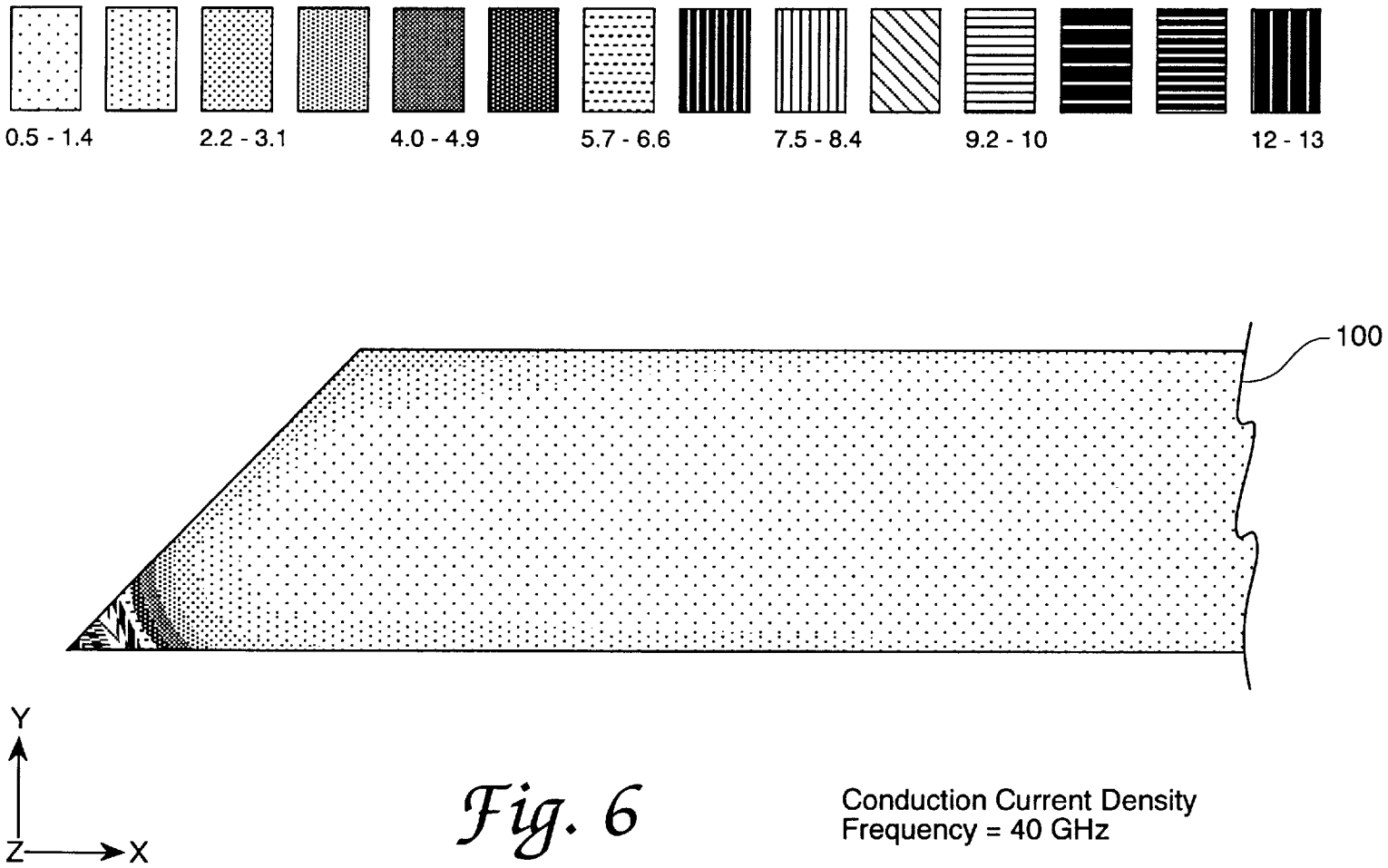
FIG. 6 shows a representation of conduction current crowding for one conductor cross-sectional shape at one operating frequency.

The following discussion is based on a 3 micrometer thick microstrip transmission line having an initial rectangular edge as is shown in FIG. 4*a*. Although a symmetrical or balanced arrangement of the transmission line conductor is usually preferred, this is not required and the present description is largely couched in terms of one end of the conductor as shown in FIG. 1. The microstrip transmission lines described in this discussion also have in their symmetric form a width W of 70 micrometers, a t measurement (i.e., a measurement of conductor thickness) of 3 micrometers, a dielectric constant of 12.9 and involve a substrate height H of 100 micrometers. The microstrip transmission line characteristic impedance is 50±2 Ohms. A plot of measured transmission line losses compared with calculated transmission line losses and with respect to frequency for such a transmission line is shown in FIG. 5 of the drawings. Note that the calculated FIG. 5 values fall along the low end of the measured data. There are several reasons for this. For example, the calculation does not account for surface roughness, ground plane losses, dielectric losses, radiation losses and the measured microstrip transmission lines may not have perfectly rectangular edges. If, in fact, the transmission line edges are trapezoidal in shape, as in FIG. 4*b*, and as is typically the case, then the losses represented in FIG. 5 will increase. FIG. 6 of the drawings shows the loss-promoting current densities to be expected in a trapezoidal shaped transmission line conductor; note the especially increased conduction current density occurring in the acute angle area at the bottom corner of the conductor edge in this FIG. Given the reasons just stated, it is moreover clear that the calculated values in FIG. 5 should be on the low side of the actual or measured data.

Figure 4C:
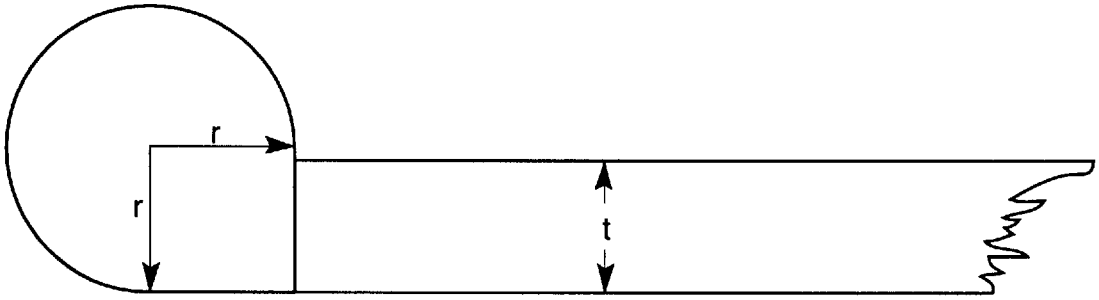
FIG. 4*c* shows a transmission line conductor configuration according to the invention for the FIG. 4*a* transmission line.
Figure 7:
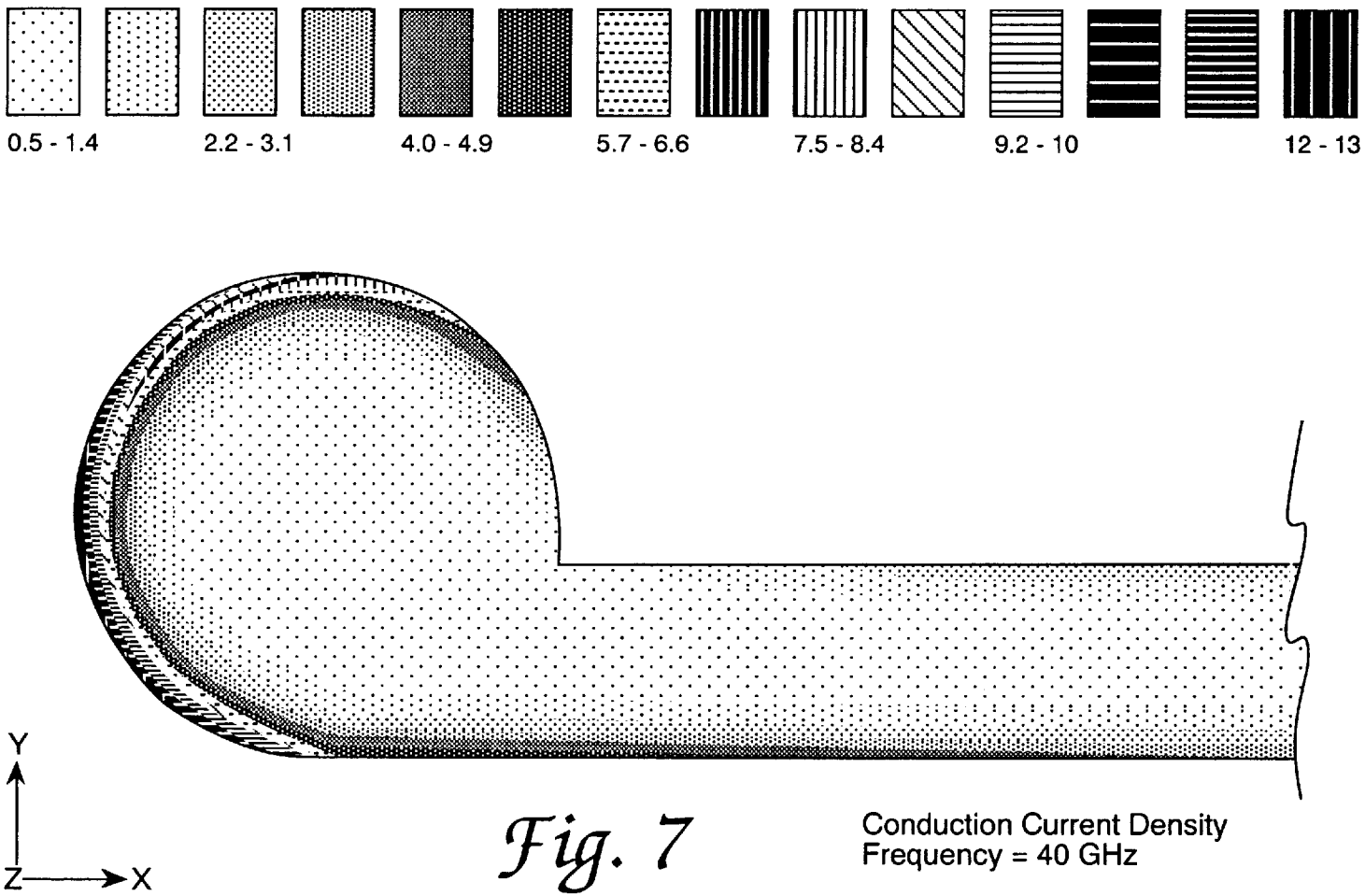
FIG. 7 shows a representation of conduction current crowding for a conductor cross-sectional shape according to the invention at one operating frequency.

When the rectangular edge and trapezoidal edge of FIG. 4*a* and FIG. 6 are, however, replaced with a cylindrical edge according to the invention, as shown in FIG. 4*c* of the drawings, the conduction current density is reduced and thus so are the incurred line losses. This edge arrangement may be seen in FIG. 7 of the drawings. Moreover from the FIG. 7 drawing it may be appreciated that the enlarged or bulbous shape of the preferred conductor cylindrical edge configuration is more desirable for current crowding and loss reduction purposes than would be, for example, a simple rounded corner shape confined within the imaginary right angle defined by projecting the conductor side and top surfaces to their intersection. A fully rounded alternate conductor edge arrangement is in fact described below along with the disadvantages attending its use. For descriptive convenience purposes herein, when the two uppermost conductor corners, as viewed in FIGS. 4*c* and 7, are rounded in this bulbous or cylindrical manner, the resulting complete transmission line conductor may be described as be, for example, in the form of an inverted catamaran boat or canoe of the type associated with the peoples of the south Pacific Ocean and other parts of the world.

Figure 8:
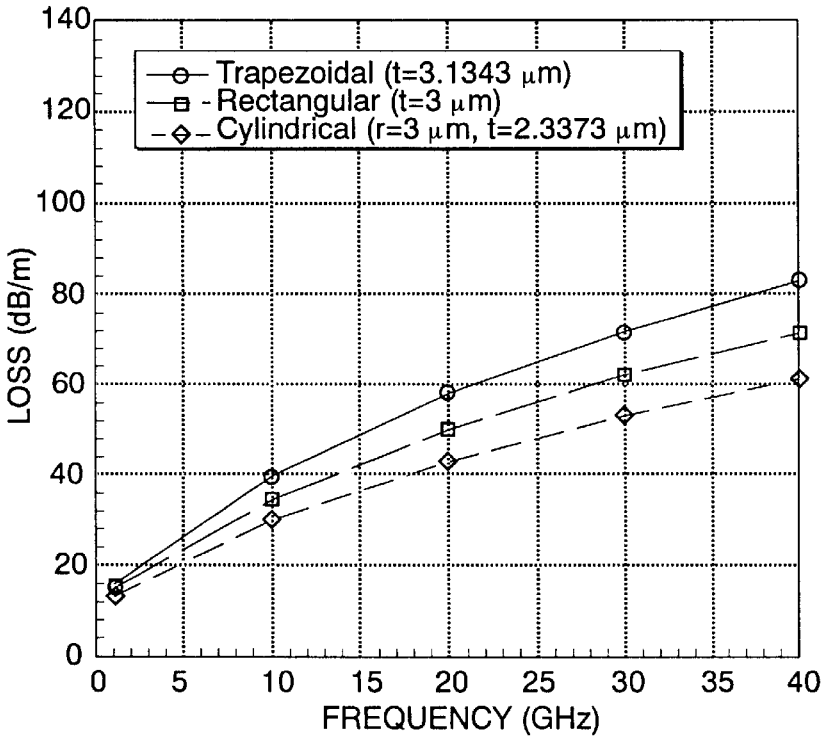
FIG. 8 shows a relationship between transmission line losses and operating frequency for three conductors of the same cross-sectional area and different conductor edge shapes.

FIG. 8 in the drawings shows a plot of losses as a function of frequency for three transmission lines each with a 210 micrometers$^2$ cross sectional area but with different edge shape geometry. At a conducted current frequency of 40 GHz, note that in comparison with the rectangular cross section, the cylindrical cross section reduces the incurred transmission line losses from 71 dB/meter to 61 dB/meter and thereby provides a 14% improvement. When the trapezoidal cross section is compared with the cylindrical cross section, the losses change from 83 dB/meter to 61 dB/meter, for a 26% improvement. FIG. 8 may also be interpreted to show that changing the edge shape geometry to a cylindrical edge without increasing the amount of metal in a transmission line conductor will in fact greatly reduce the microstrip conductor losses. Such an arrangement may not, however, be the optimum since an optimum configuration must consider operating frequency and the tradeoff between increased metal usage and line losses.

Figure 9:
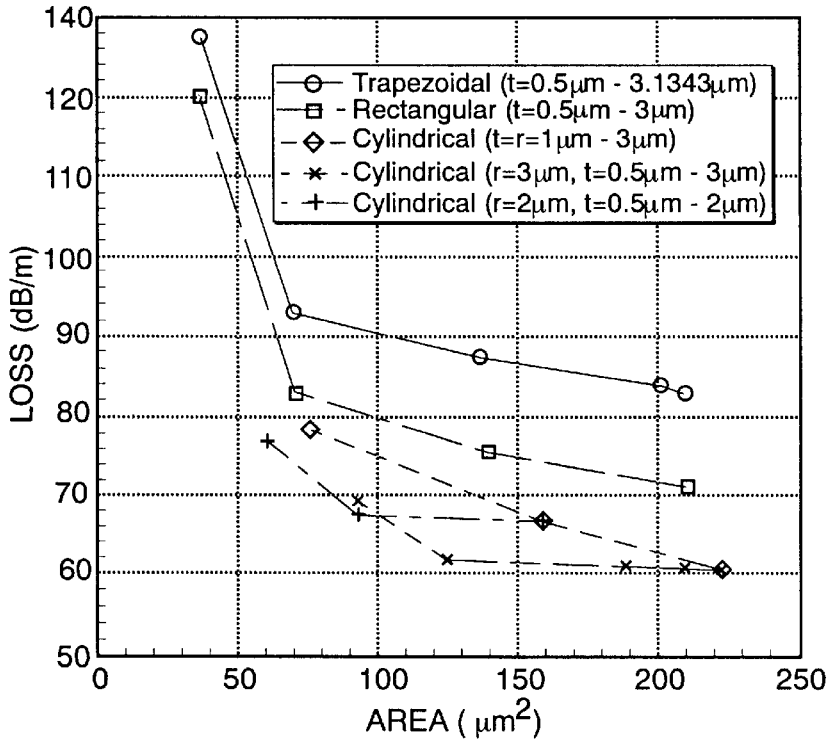
FIG. 9 shows a relationship between transmission line losses and conductor cross-sectional area for several different conductor edge shapes and one operating frequency.

FIG. 9 in the drawings shows a plot of trapezoidal, rectangular and cylindrical microstrip transmission line losses at 40 gigahertz frequency as a function of area for five different transmission line thicknesses and rounded corner cylinder radii. It is clear from this plot that the trapezoidal cross section always has the highest loss. The next highest loss is for the rectangular cross section. Physically, however, it is very difficult to fabricate a perfectly rectangular cross section microstrip transmission line. Typically a rectangular microstrip transmission line therefore has a somewhat trapezoidal edge shape. Thus the losses for a typical "rectangular" cross section microstrip transmission line often fall somewhere between the trapezoidal and rectangular curves shown in FIG. 9. The next three FIG. 9 curves are for cylindrical edge shapes with different conductor thickness and cylinder radius geometry as described in the legend of FIG. 9. An optimum transmission line conductor may include a trade-off between the amount of incurred line loss and the cross sectional area occupied by the transmission line.

A somewhat optimum arrangement for a 40 GHz transmission line may in fact be determined from the FIG. 9 curves. This may be accomplished by finding the FIG. 9 curve with the lowest loss—which is the cylindrical cross section curve with an r of 3 micrometers, i.e., the curve identified with x's in FIG. 9. The optimum arrangement is determined by moving to the left along this curve to the lowest area before the loss increases sharply, this is the point where the area is 124 $um^2$. This transmission line arrangement gives a 13% improvement in loss compared to the rectangular case with an area of 210 $um^2$ and it uses 41% less metal. Compared to the trapezoidal case with an area of 210 $um^2$ this configuration reduces losses by 25% and also uses 41% less metal. It is also possible to compare the losses at the optimum FIG. 9 point for a constant area. In this case at the point where the area equals 124 $um^2$, the cylindrical cross section with an r of 3 micrometers and a t of 1 micrometer has 20% less loss than the rectangular case and 30% less loss than the trapezoidal case.

Figure 10:
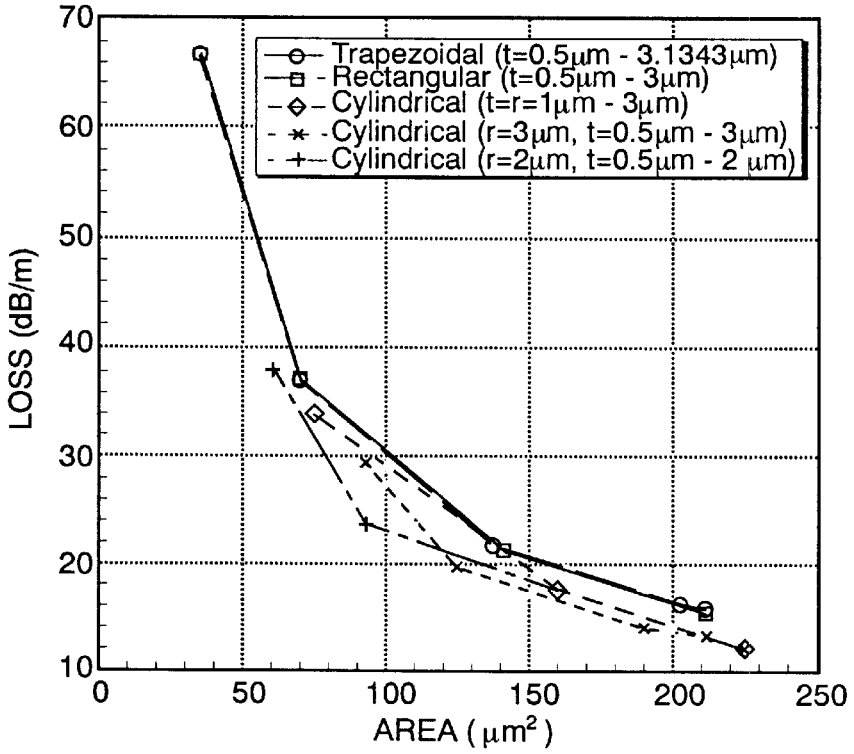
FIG. 10 shows a relationship between transmission line losses and conductor cross-sectional area for several different conductor edge shapes and a second operating frequency.
Figure 11:
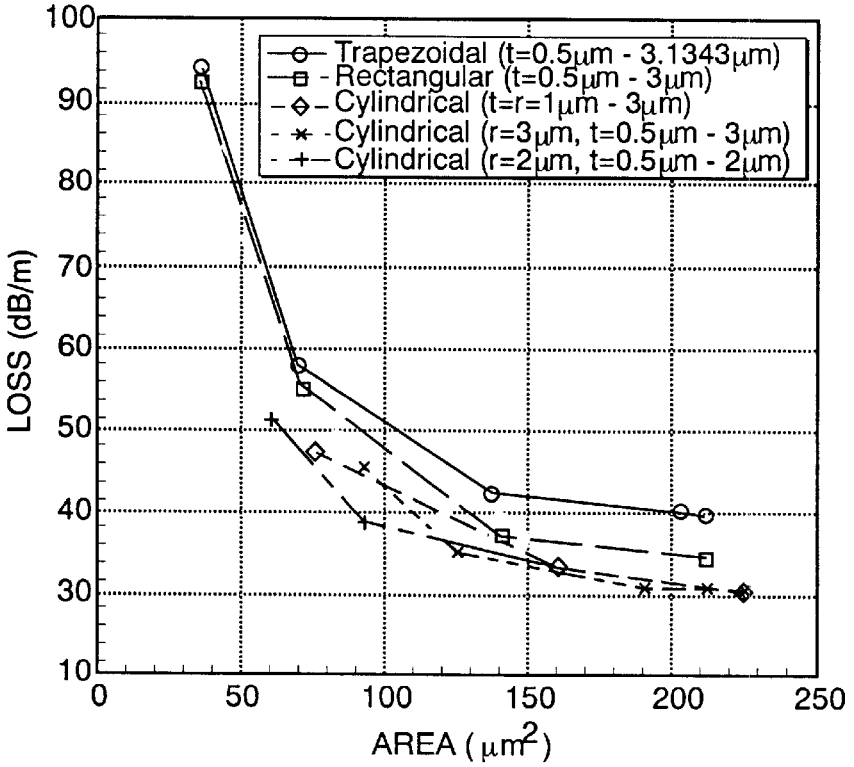
FIG. 11 shows a relationship between transmission line losses and conductor cross-sectional area for several different conductor edge shapes at a third operating frequency.

Microstrip transmission lines for monolithic microwave/millimeter wave integrated circuits and other applications are often fabricated using gold. To reduce the cost of device fabrication, decreasing the amount of metal used can therefore be important. As an example, if a transmission line with a loss of 71 dB/meter is acceptable, then from FIG. 9 the microstrip transmission line that can achieve this loss with the smallest cross section is the cylindrical microstrip transmission line with an r of 2 micrometers and an area of 80 $um^2$. This is a reduction of 62% compared to the rectangular cross section with the same amount of loss and a cross section of 210 $um^2$. Also, if the microstrip transmission line has even a slightly trapezoidal shape, the savings in metal to achieve this amount of loss would be much greater. FIGS. 10 and 11 in the drawings show the FIG. 9 type of loss as a function of cross-sectional area for current frequencies of 1 GHz and 10 GHz, respectively. The results are similar to those for the 40 GHz case.

Figure 12:
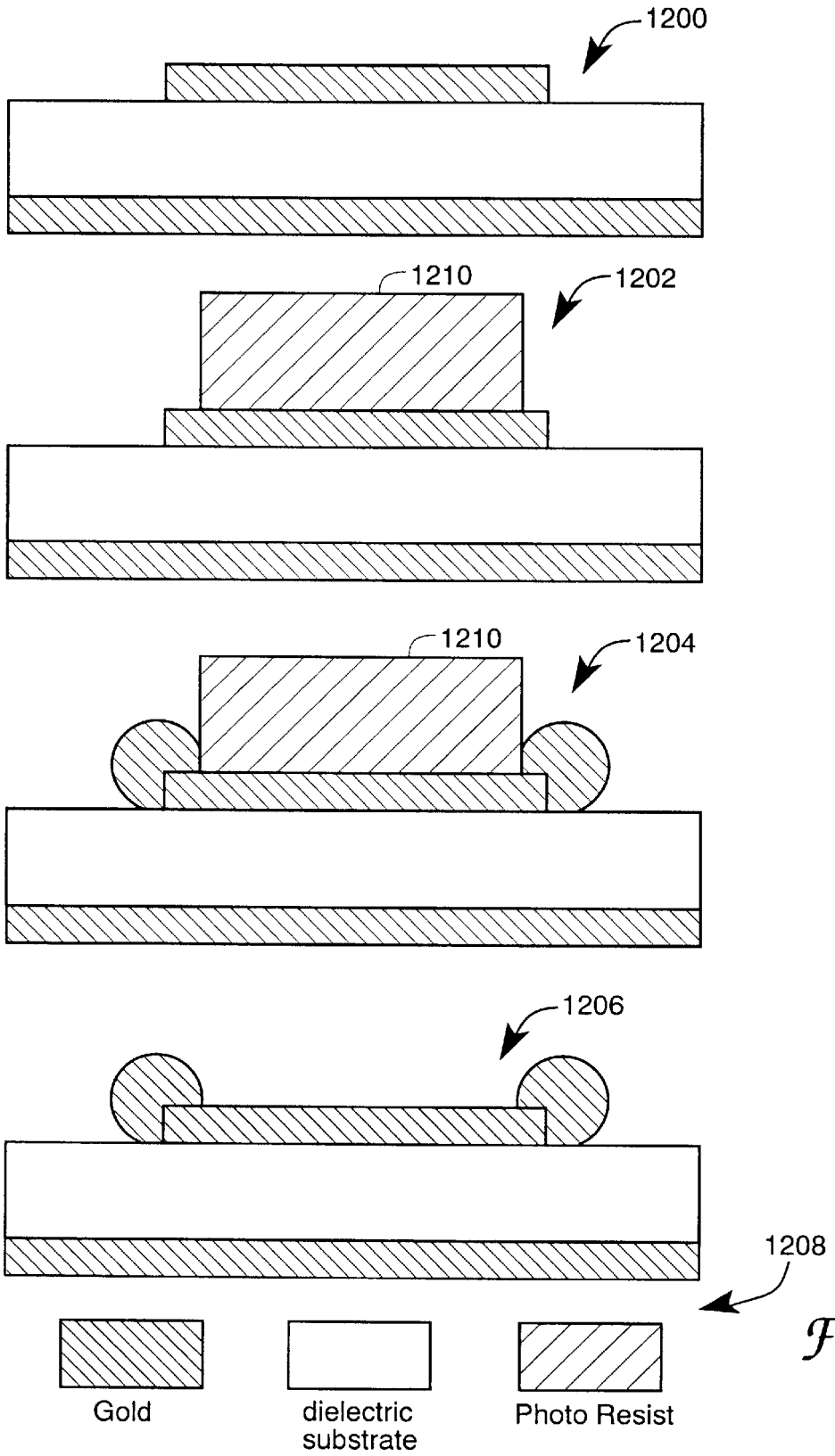
FIG. 12 shows a partial fabrication process for a transmission line according to the present invention.

One approach to the fabrication of a cylindrical edge microstrip transmission line according to the present invention is illustrated in FIG. 12 of the drawings. In this FIG. 12 drawing sequence a microstrip transmission line conductor having the desired thickness is first fabricated, as shown at 1200, using standard photolithography and either metal plating or evaporation metallization techniques. Then a thick photoresist is deposited and patterned to expose the lateral edges of the microstrip transmission line as shown at 1202. Next, the cylindrical edge elements are formed by electroplating the exposed lateral edges of the microstrip conductor as represented at 1204 in FIG. 12. Lastly, the photoresist 1210 is removed, as appears at 1206. All of these steps are standard processing steps used in fabricating typical microstrip transmission lines. The only notable requirement is a good electroplating process for the cylindrical edge elements, a process wherein the achieved grain size is much smaller than a skin depth thickness. Material compositions are indicated in the key at 1208 in FIG. 12.

FIG. 12 and other descriptive material herein indicate the transmission line of the described embodiment of the present invention to be fabricated using gold metallization and gallium arsenide semiconductor materials. These materials are indeed desirable in many military and other cutting edge applications of the improved transmission line invention, applications wherein device performance is perhaps at least equal in importance to cost. Clearly, however other materials including silicon semiconductor material and aluminum metalizations can be employed in other arrangements of the invention. The cylindrical or bulbous cross sectional shape for a transmission line conductor edge and other aspects of the invention may also be extended to other conductor types, such as the wire-bond leads used to connect integrated circuit wafer nodes to lead frame nodes. A different fabrication process may, however, be desirable for these other conductors.

Figure 13:
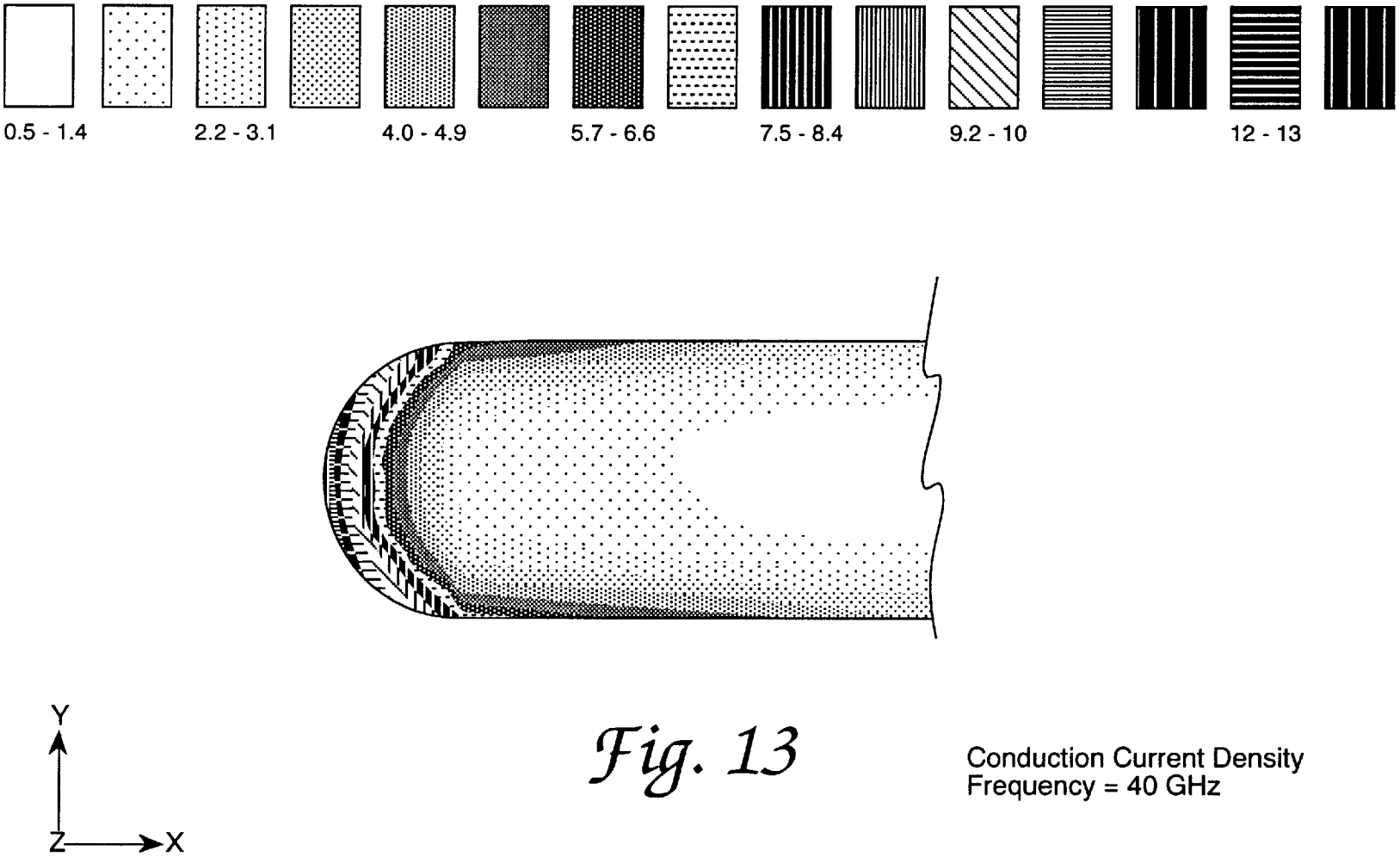
FIG. 13 shows a representation of conduction current crowding for an alternate conductor cross-sectional shape and one operating frequency.
Figure 14A:
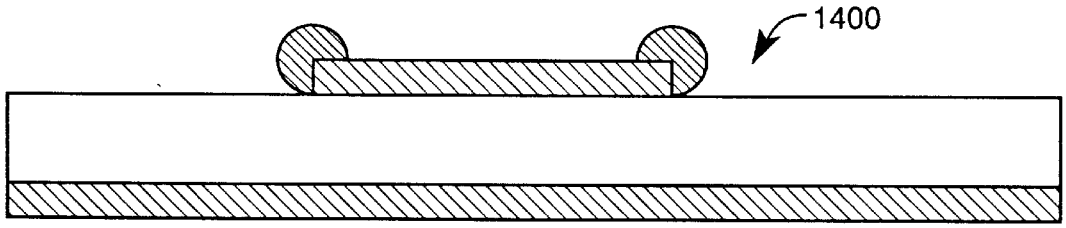
FIG. 14 shows several different microstrip transmission line arrangements according to the invention.
Figure 14B:
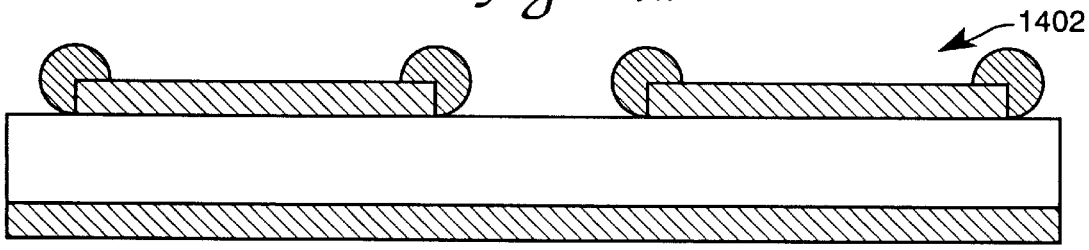
Figure 14C:
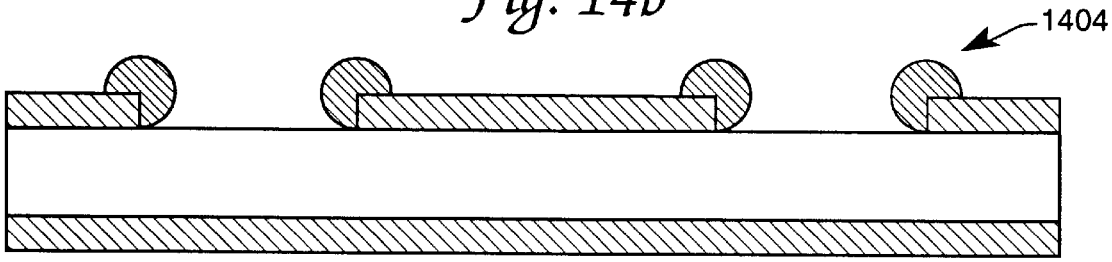
Figure 14D:
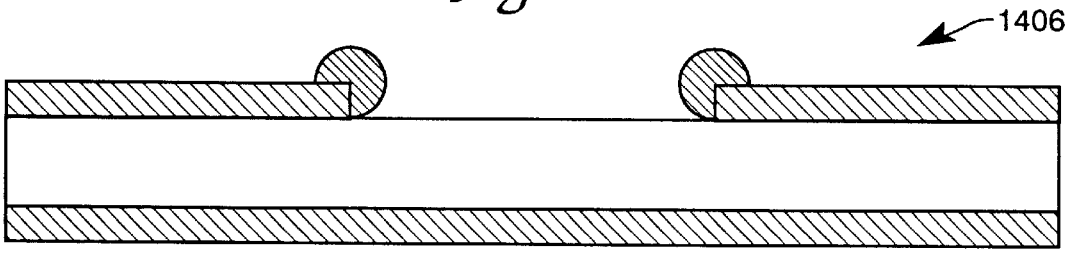
Figure 14E:
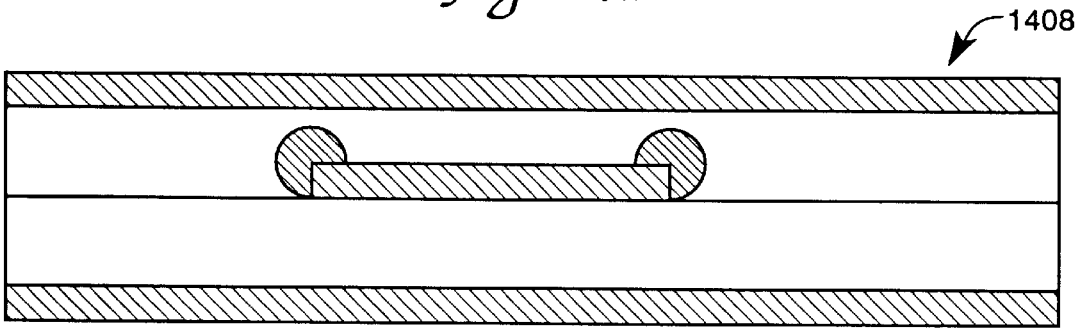

One alternative arrangement of the transmission line of the invention, an arrangement providing reduced edge corners, is achieved with round off of the conductor edges as is shown for the left hand conductor edge portion in FIG. 13 of the drawings. However, this FIG. 13 fully rounded conductor arrangement results in only a 4% decrease in transmission line loss and a 1% decrease in metal usage. Furthermore, fabricating this microstrip transmission line is difficult because of the large overhang of photoresist material required to prevent metal build-up on top of the conductor during electroplating.

FIGS. 14*a*–14*e* of the drawings show several different arrangements of a planar transmission line according to the invention. The single conductor cylindrical edge microstrip transmission line arrangement at 1400 in FIG. 14*a* has been used as a vehicle for disclosure of the invention up to this point. The cylindrical edge line at 1402 in FIG. 14*b* involves a balanced conductor line arrangement with two parallel conductors, one of which may be either grounded or ungrounded. The concept of the invention is applied to a coplanar transmission line with either grounded or ungrounded individual conductors at 1404 in FIG. 14*c* and to the "slotline" transmission line arrangement at 1406 in FIG. 14*d*. A stripline arrangement with a cylindrical edge center conductor is shown at 1408 in FIG. 14*e*. In each of these examples the concept of the present invention provides a transmission line of reduced energy loss characteristics and reduced metallization cost. As these different transmission line arrangements imply, the concepts of the invention lend to variety of different transmission line and transmission line conductor configurations.

While the apparatus and method herein described constitute a preferred embodiment of the invention, it is to be understood that the invention is not limited to this precise form of apparatus or method and that changes may be made therein without departing from the scope of the invention which is defined in the appended claims.

What is claimed is:

1. Integrated circuit microwave and millimeter wave transmission line apparatus comprising the combination of:

a transmission line dielectric layer member comprised of electrically insulating material of selected composition, dielectric constant and thickness dimension received within an integrated circuit electronic device;

an electrically conductive transmission line backplane member received on a bottom-most surface of said transmission line dielectric layer member; and an electrically conductive transmission line signal conductor member of closed geometric figure lower cross-sectional portion shape, selected metallic composition, and selected cross-sectional width and thickness dimensions received on a topmost surface of said transmission line dielectric member;

said electrically conductive transmission line signal conductor member including a metallic conduction surface area-increasing upper cross-sectional external corner portion of bulbous rounded cross-sectional shape as an integral and lengthwise-extending portion thereof.

2. The microwave and millimeter wave transmission line apparatus of claim 1 further including a cross-sectional external corner portion of bulbous rounded cross-sectional shape disposed at two transmission line signal conductor member upper-most cross-sectional surface corners.

3. The microwave and millimeter wave transmission line apparatus of claim 1 wherein said transmission line dielectric layer member, said transmission line signal conductor member and said transmission line backplane member are disposed in physical and electrical relationships characterized by a selected transmission line characteristic impedance.

4. The microwave and millimeter wave transmission line apparatus of claim 3 wherein said selected characteristic impedance is an impedance of 50 ohms.

5. The microwave and millimeter wave transmission line apparatus of claim 1 wherein said electrically insulating material of selected composition is comprised of gallium arsenide semiconductor material.

6. The microwave and millimeter wave transmission line apparatus of claim 1 wherein said electrically conductive transmission line signal conductor member is comprised of metallic gold.

7. The microwave and millimeter wave transmission line apparatus of claim 1 wherein said metallic conduction surface area-increasing upper cross-sectional shape of said transmission line signal conductor member has a radius in said bulbous rounded cross-sectional region equal to a conductor thickness dimension.

8. The microwave and millimeter wave transmission line apparatus of claim 1 wherein said electrically conductive transmission line signal conductor member has rectangular cross-sectional dimensions of 3 microns by 70 microns and said metallic conduction surface area-increasing upper cross-sectional shape has a radius in said bulbous rounded cross-sectional region equal to a conductor thickness dimension.

9. A microwave transmission line conductor of controlled skin effect current density crowding characteristics comprising the combination of:

an extended length of electrically conductive metal of selected thickness and substantially rectangular cross-sectional shape connected at endpoints thereof to two microwave signal nodes;

said electrically conductive metal of substantially rectangular cross-sectional shape including at least one electrical skin effect surface area-increasing bulbous cross-sectional corner region of diameter equal to at least twice said conductive metal selected thickness and extending lengthwise of said electrically conductive metal.

10. The microwave transmission line conductor of controlled skin effect current density crowding characteristics of claim 9 further including a second electrical skin effect surface area-increasing bulbous cross-sectional corner region of diameter equal to at least twice said conductive metal selected thickness disposed at a distal cross-sectional end region of said transmission line conductor.

* * * * *